US005949339A

United States Patent [19]

Ettinger et al.

[11] Patent Number: 5,949,339

[45] Date of Patent: Sep. 7, 1999

[54] METHOD OF REDUCING INJURIES TO RIDERS AND A RIDING CINCH

[76] Inventors: Stanley James Ettinger; Betty Lou Ettinger, both of P.O. Box 986; Donald Henry Tuchscherer; Idella Jean Tuchscherer, both of P.O. Box 1181, all of Stettler, Alberta, Canada, T0C 2L0

[21] Appl. No.: 09/012,259

[22] Filed: Jan. 23, 1998

[30] Foreign Application Priority Data

Feb. 7, 1997 [CA] Canada ..... 2197024

[51] Int. Cl.[6] ..... G08B 23/00

[52] U.S. Cl. ..... 340/573.1; 340/568.1; 340/539; 54/1; 54/23; 54/44.1; 54/46.1; 54/49; 70/58; 70/57; 70/57.1; 70/261

[58] Field of Search ..... 340/573, 568, 340/539; 54/1, 71, 23, 46.1, 44.1, 49; 70/58, 55, 71, 14, 18, 229, 232, 57.1, 261, 57, 256

[56] References Cited

U.S. PATENT DOCUMENTS

| | | | |
|---|---|---|---|
| 4,823,568 | 4/1989 | Rogers et al. | 70/58 |
| 5,031,387 | 7/1991 | Rider | 54/23 |
| 5,339,610 | 8/1994 | Mondry | 54/1 |

FOREIGN PATENT DOCUMENTS

437118A1 1/1990 European Pat. Off. .

*Primary Examiner*—Benjamin C. Lee
*Attorney, Agent, or Firm*—Davis and Bujold

[57] ABSTRACT

A method of reducing injuries to riders and associated riding cinch. Firstly, providing a riding cinch that has a locking mechanism with a electrically controlled release for locking a first coupling and a second coupling. Secondly, providing a remote transmitter adapted to send a signal to signal receiving means to selectively activate a release activating circuit by closing a switch to permit power to flow from a power source to the electrically controlled release for the locking mechanism. Thirdly, securing the riding cinch to an animal to be ridden. Fourthly, activating the release activating circuit with the remote transmitter, as the rider dismounts.

7 Claims, 5 Drawing Sheets

METHOD OF REDUCING INJURIES TO RIDERS AND A RIDING CINCH

FIELD OF THE INVENTION

The present invention relates to a method of reducing injuries to riders and, in particular rodeo riders. It also relates to a riding cinch and in particular, a riding cinch used for rodeo or equestrian events.

BACKGROUND OF THE INVENTION

In the context of equestrian events, a riding cinch is a belt or strap that is used to secure a saddle to a horse. In the context of rodeo, a riding cinch also includes a cinch rope secured around a bull in order to provide the rodeo rider with a hand hold.

Every year cowboys participating in rodeo events are killed or seriously injured while attempting to dismount. The danger for bull riders is that the cowboy's hand will become caught in the cinch rope. The danger for cowboys on horseback is that they will become tangled up in the saddle. It such cases the cowboy or equestrian rider, becomes "hung up" until he or she can work free. If he or she is not able to rapidly work free, serious injuries will result.

SUMMARY OF THE INVENTION

What is required is a method and apparatus for reducing the injuries to riders participating in rodeo or other types of equestrian events.

According to one aspect of the present invention there is provided a method of reducing injuries to riders. Firstly, providing a riding cinch that has a first end and a second end. The first end has a first coupling which mates with a second coupling at the second end. The riding cinch having a locking mechanism with a electrically controlled release for locking the first coupling and the second coupling. The riding cinch also having a release activating circuit including a power source separated from the electrically controlled release by switch means adapted to be closed by signal receiving means. Secondly, providing a remote transmitter adapted to send a signal to the signal receiving means to selectively activate the release activating circuit by closing the switch means to permit power to flow from the power source to the electrically controlled release for the locking mechanism. Thirdly, securing the riding cinch to an animal to be ridden. Fourthly, activating the release activating circuit with the remote transmitter, as the rider dismounts.

With the method described above, the rider need no longer worry about being "hung up". At the first sign of being "hung up", the person with the remote transmitter is able to ensure that the cinch is released. It is preferred that the remote transmitter be secured to the hand of the rider. This enables the rider to activate the release activating circuit as the rider dismounts. This eliminates both the possibility of premature release, and the need to initiate release only if the rider becomes "hung up".

According to another aspect of the present invention there is provided a riding cinch which includes a flexible elongate body having a first end and a second end. A first coupling is secured to the first end of the body. A housing having a second coupling is secured to the second end of the body. The housing contains a locking mechanism with a electrically controlled release for locking the first coupling and the second coupling. A release activating circuit is provided including a power source separated from the electrically controlled release by switch means adapted to be closed by signal receiving means. A remote transmitter is provided which is adapted to send a signal to the signal receiving means to selectively activate the release activating circuit by closing the switch means to permit power to flow from the power source to the electrically controlled release for the locking mechanism.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
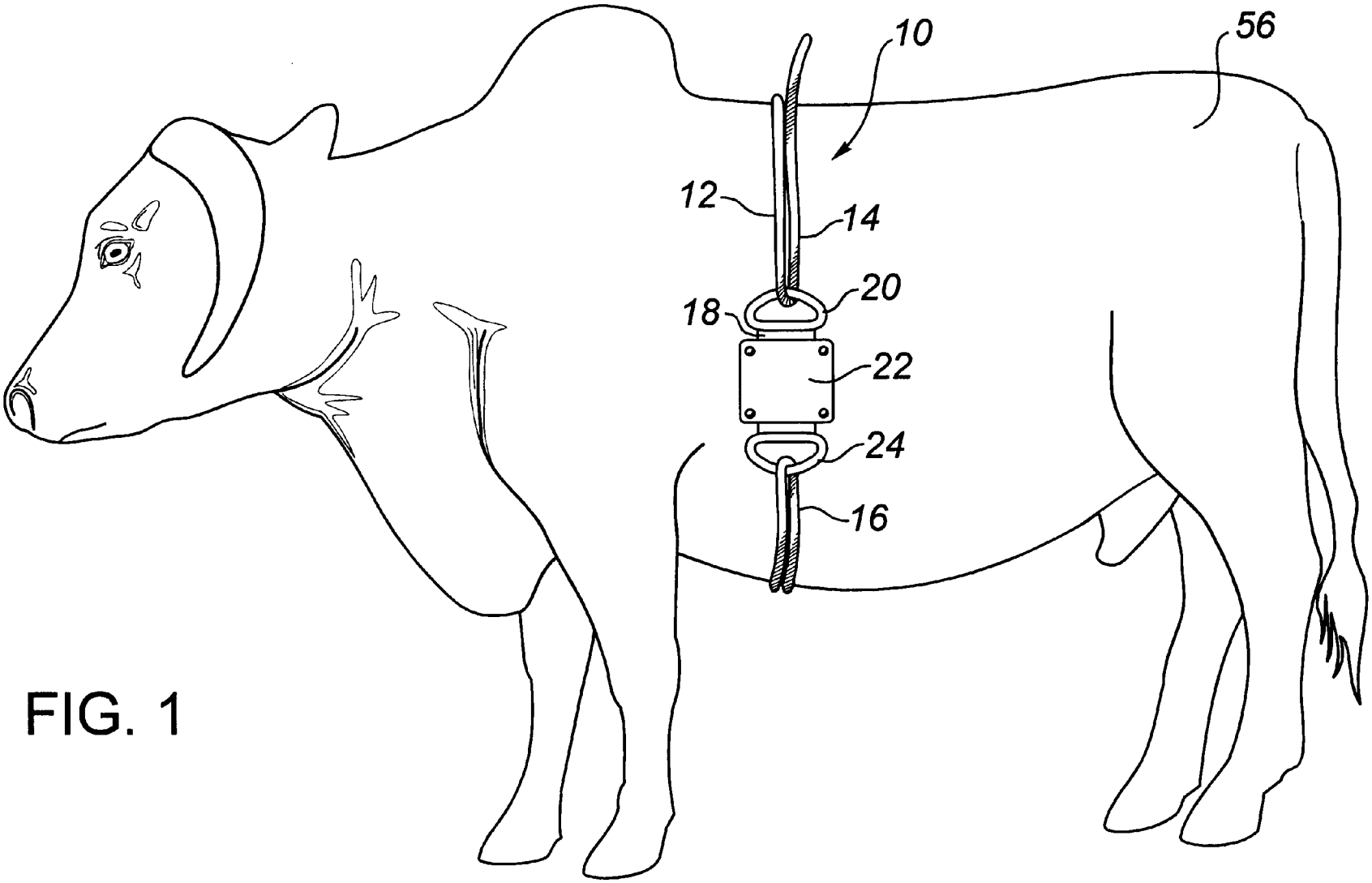
FIG. 1 is a side elevation view of a bull with a riding cinch constructed in accordance with the teachings of the present invention.

The preferred embodiment, a riding cinch generally identified by reference numeral 10, will now be described with reference to FIGS. 1 through 7.

Figure 2:
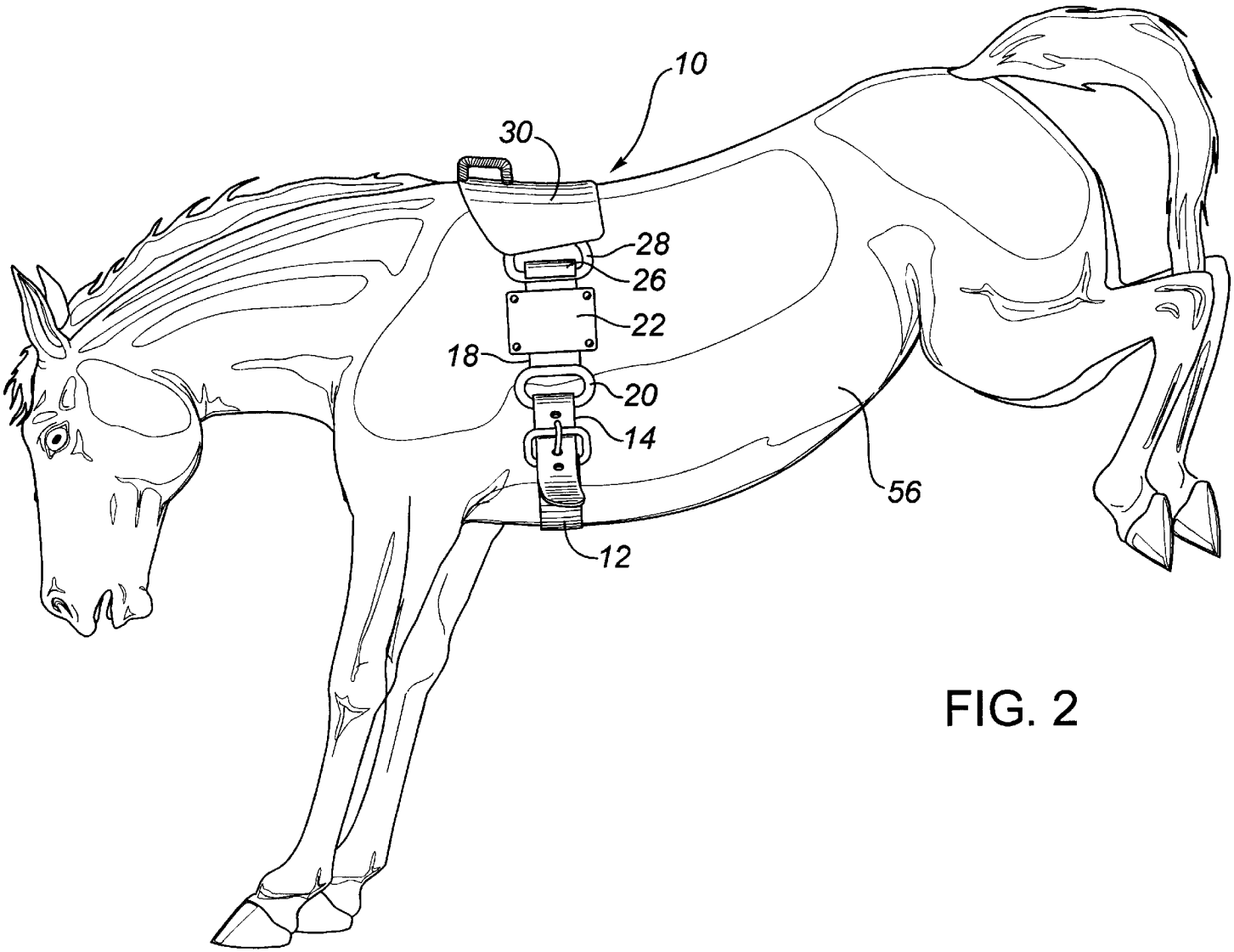
FIG. 2 is a side elevation view of a horse with a riding cinch constructed in accordance with the teachings of the present invention connected as part of bare back rigging.
Figure 3:
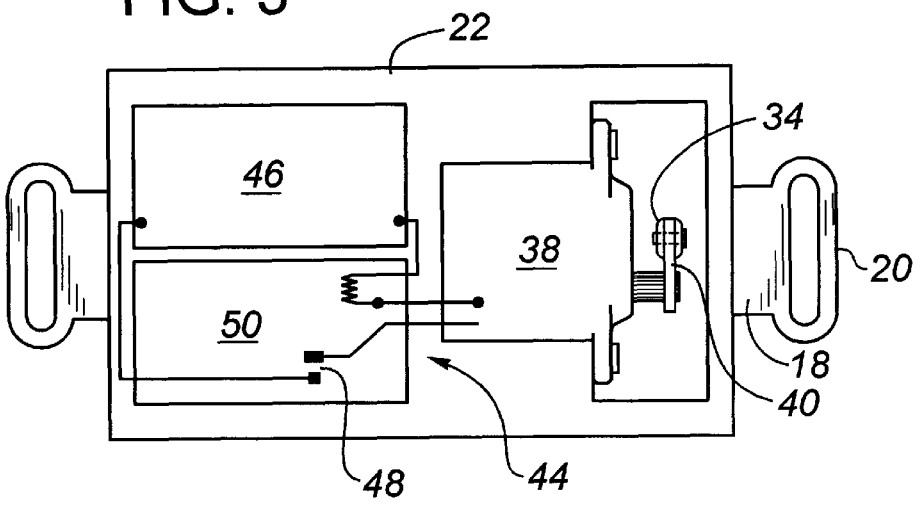
FIG. 3 is a top plan view, in section of a housing portion of the riding cinch illustrated in FIGS. 1 and 2.
Figure 5:
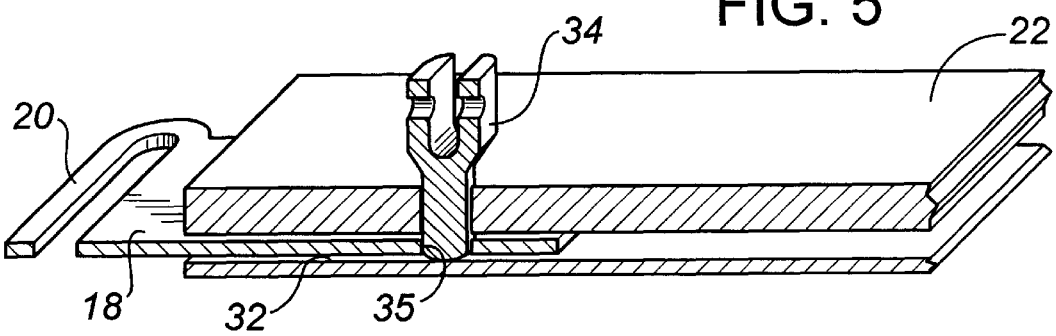
FIG. 5 is a side elevation view, in section, of the housing illustrated in FIG. 3 with locking mechanism in a locking position.
Figure 6:
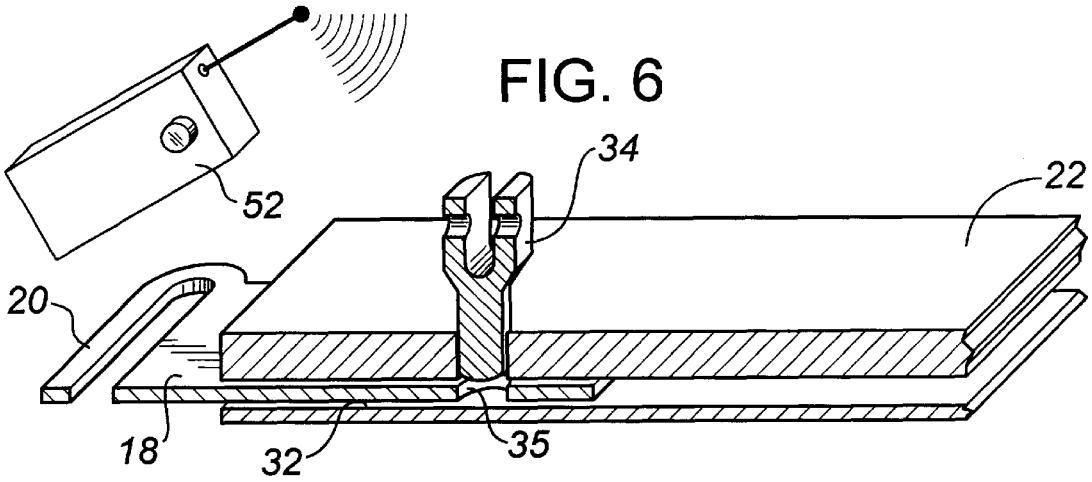
FIG. 6 is a side elevation view, in section, of the housing illustrated in FIG. 3 with locking mechanism in a release position.
Figure 4:
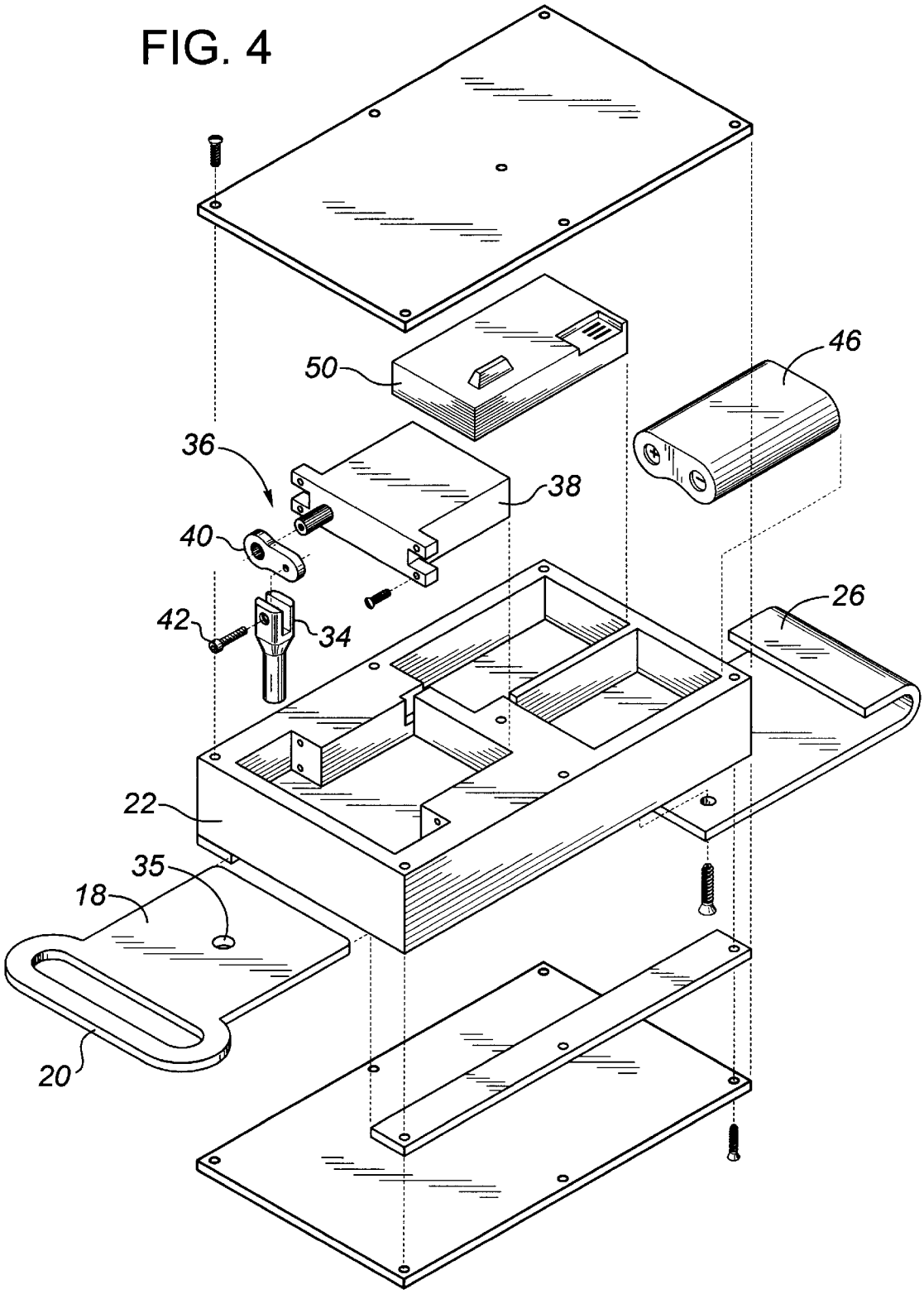
FIG. 4 is an exploded perspective view of the housing illustrated in FIG. 3.

Referring to FIGS. 1 and 2, riding cinch 10 includes a flexible elongate body 12 having a first end 14 and a second end 16. Body 12 could be in the form of a cinch rope as illustrated in FIG. 1 or in the form of a cinch strap as illustrated in FIG. 2. A male coupling 18 is secured to first end 14 of body 12. Male coupling 18 has an attachment loop 20 by means of which first end 14 is attached. A housing 22 is secured to second end 16 of body 12. In FIG. 1, the means for attaching second end 16 to housing 22 is an attachment loop 24. In FIG. 2, the means for attaching second end 16 to body 12 is a hook 26 which engages a loop 28 on a saddle 30. Referring to FIGS. 5 and 6, housing 22 has a female coupling 32 which is adapted to receive male coupling 18. Housing 22 contains a locking mechanism in the form of retractable pin 34. Referring to FIG. 4, pin 34 is retracted by means of an electrically controlled release assembly, generally indicated by reference numeral 36. Release assembly 36 includes a servo or solenoid 38 and a crank arm 40. Pin 34 is secured by a coupling pin 42 to crank arm 40, so that pin 34 moves when servo 38 imparts movement to crank arm 40. Referring to FIG. 5, pin 34 locks male coupling 18 and female coupling 32 in mating relation, by extending into an aperture 35 in male coupling 18. Referring to FIG. 3, a release activating circuit generally indicated by reference numeral 44 is illustrated. Release activating circuit 44 includes a power source in the form of battery 46 which is separated from servo 38 of electrically controlled release assembly 36 by switch means 48 adapted to be closed by receiving unit 50. Referring to FIG. 6, a remote transmitter 52 is provided which is adapted to send a signal to receiving unit 50.

Figure 7:
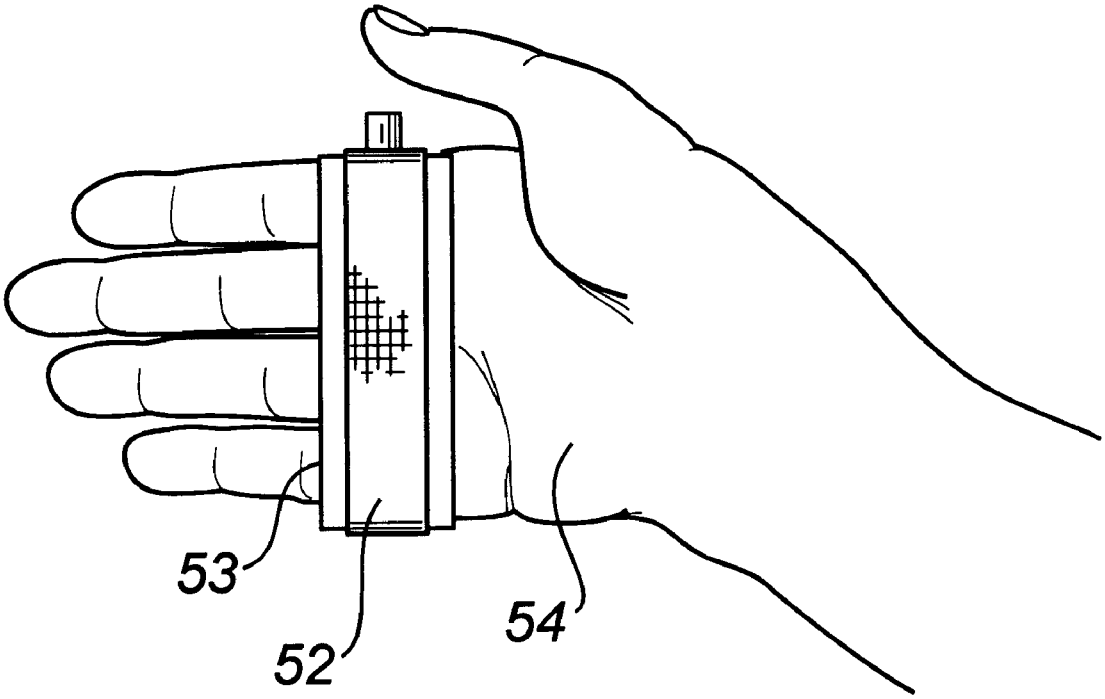
FIG. 7 is a perspective view illustrating a transmitter associated with the riding cinch secured to the hand of a rider.

The use and operation of riding cinch 10 will now be described in relation to FIGS. 1 through 7 and the preferred method. The method was developed with a view to reducing injuries to riders. The first step of the method involves providing a riding cinch, such as riding cinch 10 that can be activated by sending a signal to a receiving unit, such as receiving unit 50. Referring to FIG. 7, The second step involves providing remote transmitter 52 which is compatible with receiving unit 50. It is preferred that remote transmitter 52 be secured to a hand 54 of a rider (not shown) by straps 53. Referring to FIGS. 1 and 2, the third step involves securing riding cinch 10 to an animal 56 which is to be ridden. Referring to FIG. 7, the fourth step involves the rider, or someone on his behalf, activating release activating circuit 44 by means of remote transmitter 52, as the rider dismounts or if the rider should become "hung up". Referring to FIG. 3, power is supplied to receiving unit 50 by battery 46 to enable receiving unit 50 to receive signals from remote transmitter 52. When receiving unit 50 receives a signal from remote transmitter 52, release activating circuit 44 is activated by closing switch 48 enabling power to flow from battery 46 to servo 38 of electrically controlled release assembly 36. Referring to FIG. 4, servo 38 moves crank arm 40, which withdraws pin 34 from aperture 35 of male coupling 18. When securing riding cinch 10 to animal 56, it is preferred that housing 22 be secured from below. With this manner of securement, the weight of housing 22 helps aid in the separation of male coupling 18 from female coupling 32. With the separation of male coupling 18 and female coupling 32, riding cinch 10 falls free of animal 56, ensuring that the rider does not become hung up.

While the described method and riding cinch 10 were developed for rodeo events, it will be understood that the teachings are equally applicable to other equestrian events. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of reducing injuries to rodeo riders, the method comprising the steps of:

providing an animal to be ridden in a rodeo event;

providing a riding cinch that has a first end and a second end, the first end having a first coupling which mates with a second coupling at the second end, the riding cinch having a locking mechanism with an electrically controlled release for locking the first coupling and the second coupling, and a release activating circuit including a power source separated from the electrically controlled release by switch means adapted to be closed by signal receiving means;

providing a remote transmitter adapted to send a signal to the signal receiving means to selectively activate the release activating circuit by closing the switch means to permit power to flow from the power source to the electrically controlled release for the locking mechanism;

securing the riding cinch to the animal being ridden; and activating the release activating circuit with the remote transmitter as the rider dismounts whereby when the release activating circuit is activated the first coupling and the second coupling disengage from one another causing the riding cinch to become unsecured from the animal and thereby prevent a rider from becoming entangled with the animal upon dismount.

2. The method as defined in claim 1, wherein the remote transmitter is secured to a hand of a rider, thereby enabling the rider to activate the release activating circuit as the rider dismounts.

3. The method of reducing injuries to rodeo riders of claim 1, further comprising the step of securing the riding cinch completely around a midsection of the animal between a pair of front and a pair of rear legs of the animal.

4. A riding cinch, for an animal to be ridden in a rodeo event, comprising in combination:

a flexible elongate body having a first end and a second end;

a first coupling secured to the first end of the body;

a housing having a second coupling secured to the second end of the body, the second coupling being adapted to receive the first coupling, the housing containing a locking mechanism with an electrically controlled release for locking the first coupling and the second coupling, and a release activating circuit including a power source separated from the electrically controlled release by switch means adapted to be closed by signal receiving means;

the flexible elongate body being secured completely around the animal with the first coupling received in the second coupling; and a remote transmitter adapted to send a signal to the signal receiving means to selectively activate the release activating circuit by closing the switch means to permit power to flow from the power source to the electrically controlled release for the locking mechanism, whereby when the electrically controlled release is released upon activation of the remote transmitter, the first coupling disengages from the second coupling, causing the flexible elongate body of the cinch to become unsecured from around the animal, thereby preventing a rider from becoming entangled with the animal upon dismount.

5. The riding cinch for an animal to be ridden in a rodeo event of claim 4, wherein the flexible elongate body is secured completely around a midsection of the animal between a pair of front and a pair of rear legs of the animal.

6. A riding cinch, for an animal to be ridden in a rodeo event, comprising in combination:

a flexible elongate body having a first end and a second end;

a male coupling secured to the first end of the body;

a housing having a female coupling secured to the second end of the body, the female coupling being adapted to receive the male coupling, the housing containing a locking mechanism with an electrically controlled release for locking the male coupling and the female coupling in mating relation, and a release activating circuit including a power source separated from the electrically controlled release by switch means adapted to be closed by signal receiving means;

the flexible elongate body being secured around the animal with the first coupling being received in the second coupling; and a remote transmitter adapted to send a signal to the signal receiving means to selectively activate the release activating circuit by closing the switch means to permit power to flow from the power source to the electrically controlled release for the locking mechanism, whereby when the electrically controlled release is released upon activation of the remote transmitter, the male coupling disengages from the female coupling, causing the flexible elongate body of the cinch to become unsecured from around the animal, thereby preventing a rider from becoming entangled with the animal upon dismount.

7. The riding cinch for an animal to be ridden in a rodeo event of claim 6, wherein the flexible elongate body is secured completely around a midsection of the animal between a pair of front and a pair of rear legs of the animal.

* * * * *